US008256041B1

(12) United States Patent
Girdwain

(10) Patent No.: US 8,256,041 B1
(45) Date of Patent: Sep. 4, 2012

(54) SLOTLESS SAFETY INFANT CRIB

(76) Inventor: Grace Girdwain, Burbank, IL (US)

( * ) Notice: Subject to any disclaimer, the term of this patent is extended or adjusted under 35 U.S.C. 154(b) by 0 days.

(21) Appl. No.: 13/281,492

(22) Filed: Oct. 26, 2011

Related U.S. Application Data

(63) Continuation-in-part of application No. 12/689,007, filed on Jan. 18, 2010, now abandoned.

(51) Int. Cl.
*A47D 13/06* (2006.01)

(52) U.S. Cl. ..... 5/93.1; 5/98.1

(58) Field of Classification Search ..... 5/93.1, 5/98.1, 512, 904, 905; 446/227; 16/35 R
See application file for complete search history.

(56) References Cited

U.S. PATENT DOCUMENTS 3,165,760 A * 1/1965 Abajian ..... 5/97
4,538,309 A * 9/1985 Gunter ..... 5/99.1
4,750,223 A * 6/1988 D'Arcy et al. ..... 5/99.1
4,899,496 A * 2/1990 Chew, II ..... 5/98.1
4,935,976 A * 6/1990 Milman ..... 5/93.1
4,939,582 A * 7/1990 Holdredge et al. ..... 348/836
4,973,286 A * 11/1990 Davison ..... 446/175
5,371,921 A * 12/1994 Roe ..... 16/35 R
D365,932 S * 1/1996 Reynolds et al. ..... D6/331
7,062,806 B2 * 6/2006 Merlin ..... 5/93.1
D616,216 S * 5/2010 Dumais ..... D6/390
2006/0168722 A1 * 8/2006 Ramirez ..... 5/93.1

* cited by examiner

*Primary Examiner* — Michael Trettel
(74) *Attorney, Agent, or Firm* — John D. Gugliotta, PE, Esq; Nicholas A. Mihalic

(57) ABSTRACT

An infant or baby crib is provided that eliminates the vertical slotted members normally present on the sidewalls and end-walls, and replaces these with a planar fabric, leather or canvas member that spans each sidewall or end wall, respectively. The planar member is generally flexible to prevent fixed pinch points between rigid beams or slats that have now been identified as creating a strangulation hazard. Canvas or leather side panels form a large central orifice in which a clear plastic panel forms a viewing window, thereby allowing the infant to see through the sidewall.

10 Claims, 5 Drawing Sheets

SLOTLESS SAFETY INFANT CRIB

RELATED APPLICATIONS

The present application is a Continuation-in-Part of U.S. Non-Provisional patent application Ser. No. 12/689,007, filed on Jan. 18, 2010 and now abandoned, wherein the present application claims benefit of the priority filing dale of Jan. 18, 2010.

BACKGROUND OF THE INVENTION

1. Field of the Invention

The present invention relates generally to infant cribs and, more particularly, to a safety infant crib having slot-less sidewalls.

2. Description of the Related Art

Infant cribs have been widely used and have conventionally developed to a design in which sidewalls, and optionally end walls, are used in which a number of vertical slats are spaced such as to form parallel slots therebetween. These slats terminate at horizontal upper and lower side rails.

Recently, such crib designs have been found faulty in that they create a safety hazard. In fact, the Consumer Product Safety Commission has recently issued several alerts concerning various manufacturers of such cribs in which space between the crib and the mattress have been found to pose an entrapment and suffocation risk. According to CPSC, there have been 15 reports of entrapment in these cribs, including four infants who suffocated.

Consequently, a need has now been found and felt for providing an infant crib design that maintains the use of conventional vertical sidewalls and end-walls for preventing infants from accidental egress from the confines of the crib, while at the same time eliminating the alternating slot and slat elements that have been found to pose a potential hazard.

SUMMARY OF THE INVENTION

It is therefore an object of the present invention to provide an improved infant crib.

It is a feature of the present invention to provide an improved infant safety crib that eliminates the formation of slotted opening in the sidewalls or end-walls. Briefly described according to one embodiment of the present invention, an infant or baby crib is provided that eliminates the vertical slotted members normally present on the sidewalls and end-walls, and replaces these with a planar fabric, leather or canvas member that spans each sidewall or end wall, respectively. The crib also has an upper rail having at least one manipulating device on the upper rail for a baby or infant to manipulate for entertainment or for gripping. In one embodiment, the at least one manipulating device is a substantially circular knob capable of spinning and rotating when manipulated by a baby or an infant.

The planar member is anticipated as being of a generally flexible material to prevent fixed pinch points between rigid beams or slats that have now been identified as creating a strangulation hazard, and can alternately be formed of a composite planar material that forms a mesh-structure. However, in such a configuration it is intended that any openings forming a 'mesh' would be formed of sufficiently small orifices such as to prevent the capture or impingement of infant's body parts (fingers, arms, noses, etc.). In the preferred embodiment, a canvas or leather side panel would be formed having a large central orifice in which a clear plastic panel would be retained to form a viewing window, thereby allowing the infant to see through the sidewall. Further, the baby or infant crib also has a base having a wheel attachment disposed below each of the four corners of the base. The wheel attachments are covered with a wheel gripper for restricting movement of the crib once placed in a certain position and to reduce noise associated with movement of the wheel attachments. The wheel grippers can be made of rubber or the like, and once the wheel grippers are disposed on the wheel attachments the bottom of each wheel gripper should preferably be level with the floor while the top part of the wheel gripper would encase the wheel attachment.

In accordance with a preferred embodiment, such a clear panel forming a viewing window would be affixed within the large orifice in a secured, sealed manner and having rivets or other means of fastening securing the plastic window to the fabric, leather or canvas. Any such fasteners can be covered in felt or any equivalent or similar material to provide a soft surface finish for preventing scratches or abrasions to the crib occupant. Further, the viewing window also has an entertainment device for entertaining the baby or infant while the infant or baby is in the crib. The entertainment device has a sound functionality element and a lighted visual element. The sound functionality element can play soft music or any type of music that would entertain a baby or infant. The lighted visual element can serve as a light source during night. The lighted visual element can also display various aesthetic scenes including displays of animals, stars, clouds, or the like for entertaining a baby or infant. Alternatively, the lighted visual element can produce an alternately colored lighted display. The entertainment device can be powered by batteries which are placed in a secure chamber for safety reasons. The entertainment device also has a timer device in which the sound functionality element and lighted visual element are placed on a timer to function only during predetermined fixed intervals.

An advantage of the present invention is that is eliminates the use of spaced, rigid slats that form hazardous impingement points.

Another advantage of the present invention is that is can still provide a viewing window to the occupant that otherwise conventional slots would provide.

Further, a preferred embodiment of the present invention can be made of available materials and construction techniques to provide an industrial design that functions like and appears similar to conventional crib designs, without those elements found to be potentially dangerous.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
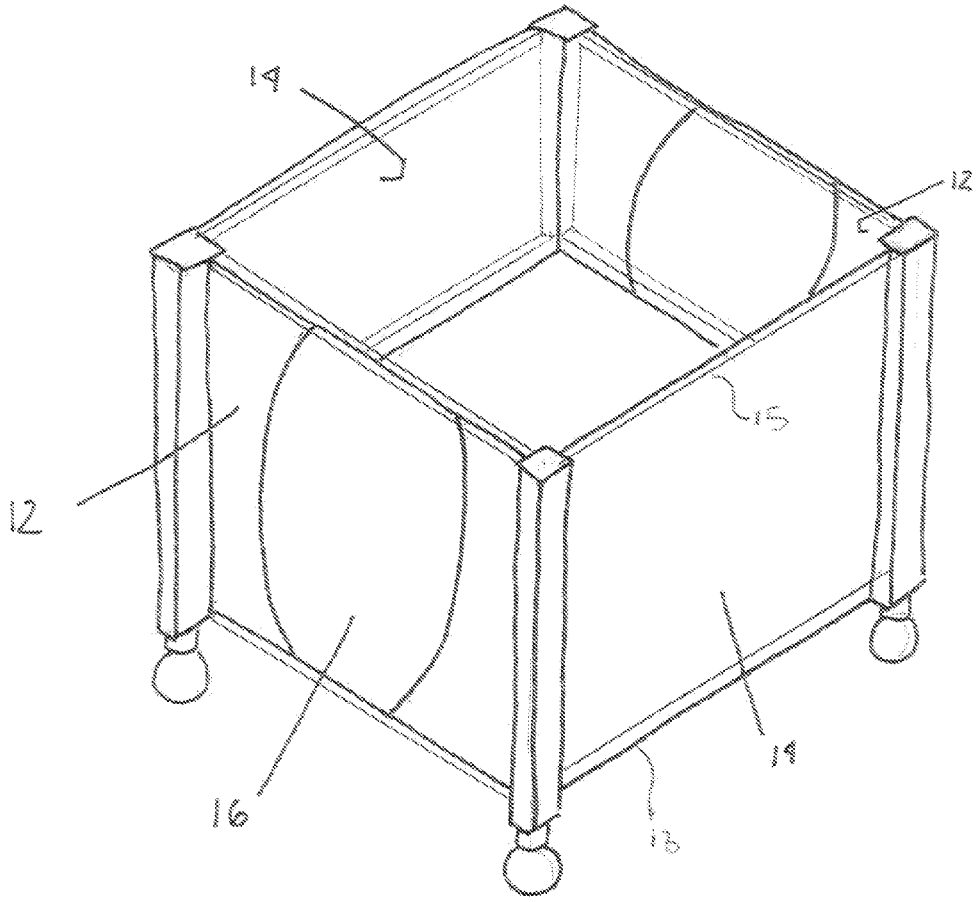
FIG. 1 is a perspective view of a slot-less safety infant crib according to the preferred embodiment of the present invention.
Figure 2:
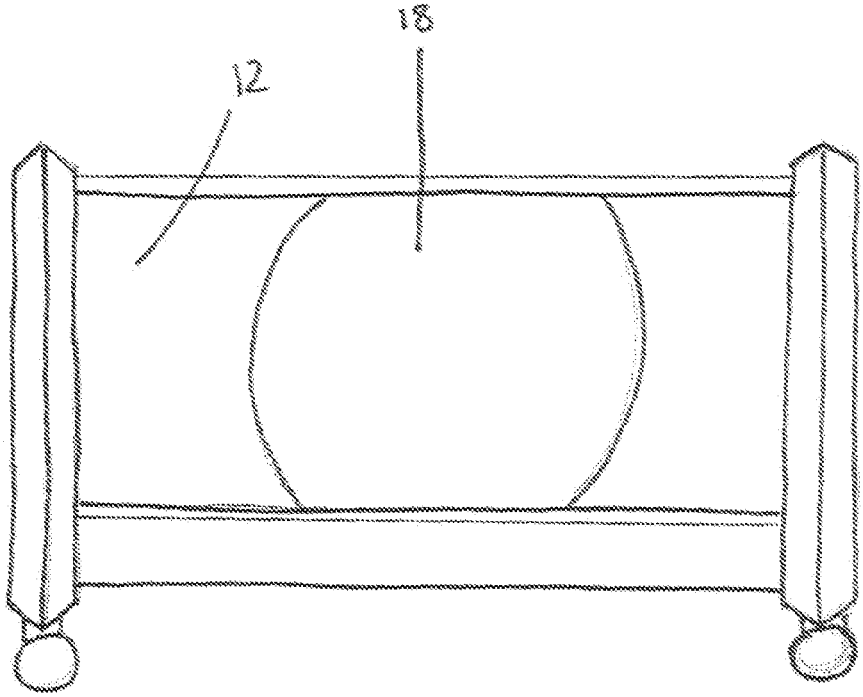
FIG. 2 is a side elevational view thereof.
Figure 3:
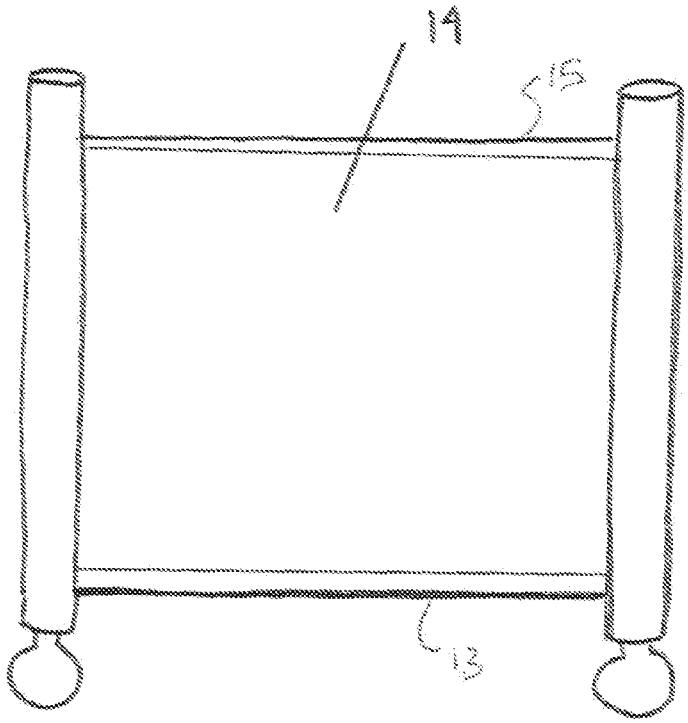
FIG. 3 is a front elevational view thereof.

The best mode for carrying out the invention is presented in terms of its preferred embodiment, herein depicted within the Figures

1. Detailed Description of the Figures

Referring now to FIGS. 1-3 and 5, an infant or baby crib, generally noted as 10, is shown according to the preferred embodiment of the present invention, have a pair of vertical sidewalls 12 and a pair of perpendicularly connecting end-walls 14. The sidewalls 12 and end-walls 14 eliminate the vertical slotted members normally present on the sidewalls and end-walls, and the vertical slotted members are replaced with a planar fabric, leather or canvas member 16 that spans each sidewall 12 or end wall 14, respectively. The planar fabric, leather or canvas is retained within horizontally disposed upper rails 13 and lower rails 15. The upper rail 13 has at least one manipulating device 50 on the upper rail 13 for a baby or infant to manipulate for entertainment or for gripping. In one embodiment, the at least one manipulating device 50 is a substantially circular knob 50 capable of spinning and rotating when manipulated by a baby or an infant. Further, the baby or infant crib also has a base 52 having a wheel attachment 54 disposed below each of the four corners of the base 52. The wheel attachments 54 are covered with a wheel gripper 56 for restricting movement of the crib once placed in a certain position and to reduce noise associated with movement of the wheel attachments 54. The wheel grippers 56 can be made of rubber or the like, and once the wheel grippers 56 are disposed on the wheel attachments 54 the bottom of each wheel gripper 56 should preferably be level with the floor while the top part of the wheel gripper 56 would substantially encase the wheel attachment 54.

Figure 4:
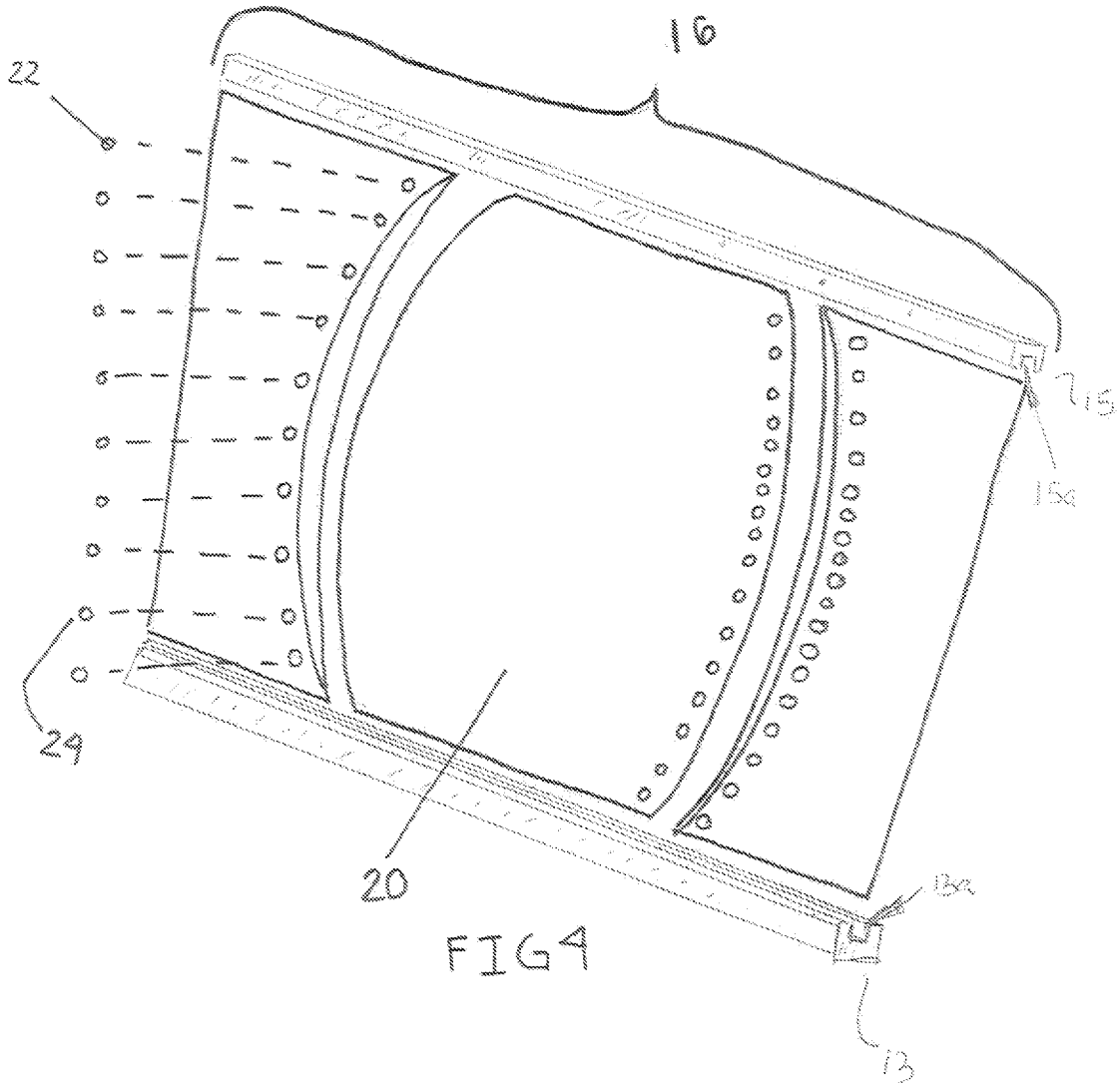
FIG. 4 is a partial exploded perspective view of a sidewall 12 for use therewith.
Figure 5:
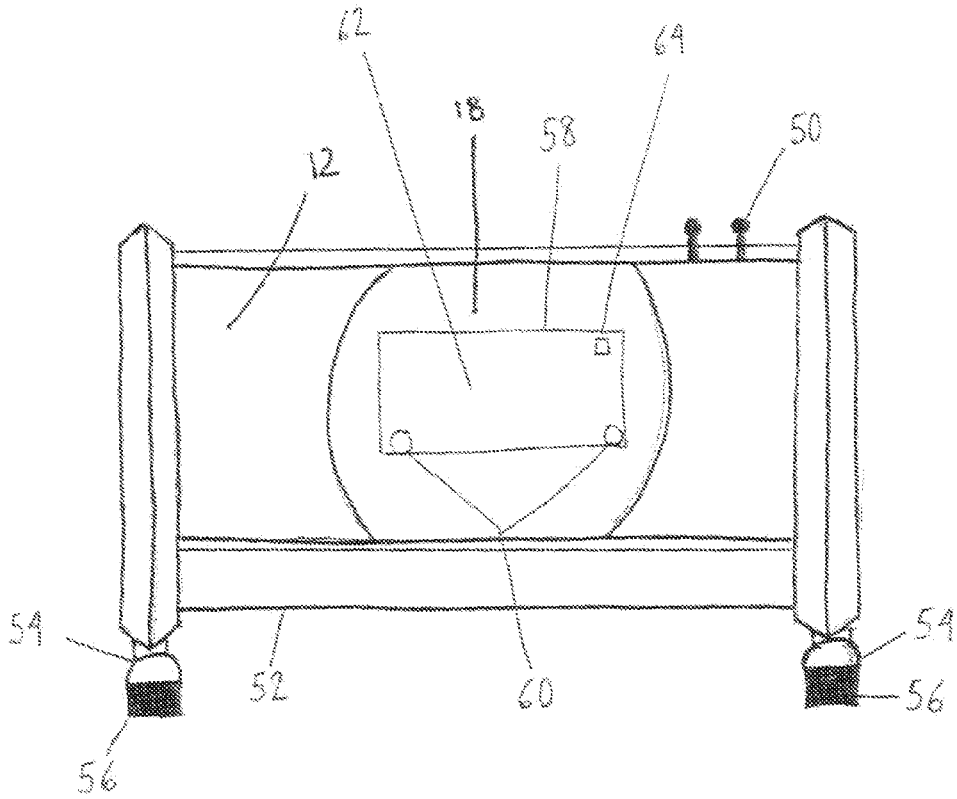
FIG. 5 is a side elevational view thereof according to a second embodiment according to the present invention.

As shown in greater detail in conjunction with FIG. 4, the planar member 16 is anticipated as being of a generally flexible material having an absence of pinch points between rigid beams or slats. It is anticipated that alternate, equivalent construction can be utilized within the teachings of this disclosure, and can therefore be formed of a composite planar material that forms a mesh-structure. However, in such a configuration it is intended to be without orifices such as to prevent the capture or impingement of infant's body parts (fingers, arms, noses, etc.). The upper edge of the planar member 16 is secured to a horizontal upper railing 15 which forms a first slot 15*a* along the horizontal elongated centerline of the railing 15. The securement of this upper edge of the planar member 16 is accomplished through attachment within this slot 15*a*. With the slot filled with planar member material affixed with and adhesive in addition to mechanical fasteners, this railing thereby provides rigid attachment while again preventing any pinch points. Similar attachment of the lower edge of the planar member 16 is anticipated with a lower railing 13 forming a horizontally elongated second slot 13*a*. With the canvas or leather planar member 16 pulled taut, the side walls and end walls will remain secure but safe for the occupant.

In any preferred embodiment, the side panel 16 would form a large central orifice 18 in which a clear plastic or PLEXIGLASS® transparent polymeric sheet material panel 20 would be retained to form a viewing window, thereby allowing the infant to see through the sidewall. The clear panel 20 forming a viewing window would be affixed within the large orifice 18 in a secured, sealed manner and having rivets or other means of fastening 22 securing the plastic window to the fabric, leather or canvas. Any such fasteners can be covered in felt 24 or any equivalent or similar material to provide a soft surface finish for preventing scratches or abrasions to the crib occupant. Further, the viewing window also has an entertainment device 58 for entertaining the baby or infant while the infant or baby is in the crib. The entertainment device 58 has a sound functionality element 60 and a lighted visual element 62. The sound functionality element 60 can play soft music or any type of music that would entertain a baby or infant. The lighted visual element 62 can serve as a light source during night. The lighted visual element 62 can also display various aesthetic scenes including displays of animals, stars, clouds, or the like for entertaining a baby or infant. Alternatively, the lighted visual element 62 can produce an alternately colored lighted display. A timer device 64 is also provided for regulating the sound functionality element 60 and the lighted visual element 62 for fixed intervals. For example, the timer device 64 can be set so that the sound functionality element 60 or the lighted visual element 62 will function for 15 consecutive minutes or 30 consecutive minutes and then ceasing function once the time interval is completed.

2. Operation of the Preferred Embodiment

In operation, the present invention is can be used in the same manner as an otherwise conventional crib. The clear panel 20 forming a viewing window would be affixed within the large orifice in a secured, sealed manner and having rivets or other means of fastening securing the plastic window to the fabric, leather or canvas. The use of planar sidewalls eliminates the use of spaced, rigid slats that form hazardous impingement points. Further, a preferred embodiment of the present invention can be made of available materials and construction techniques to provide an industrial design that functions like and appears similar to conventional crib designs, without those elements found to be potentially dangerous.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

Having thus described the invention what is claimed as new and desired to be secured by Letters Patent is as follows:

1. An infant or baby crib comprising:

a first generally vertical sidewall having a front end opposite a rear end;

a second generally vertical sidewall generally parallel to said first generally vertical sidewall and having a front end opposite a rear end;

a first generally vertical end wall, connecting said first ends of said first and second generally vertical sidewalls;

a second generally vertical end wall generally parallel to said first generally vertical end wall and connecting said second ends of said first and second generally vertical sidewalls;

wherein said first and second generally vertical sidewalls and first and second generally vertical end walls form a continuous structure having no access points;

said first sidewall further comprising a smooth planar material having no access points;

said planar material forming a large central orifice extending from a top of said sidewall to a bottom of said sidewall for retaining a clear panel forming a viewing window through said sidewall; and wherein said viewing window is formed of clear plastic or the like.

2. The infant or baby crib of claim 1, wherein said clear panel forming a viewing window is affixed within said orifice in a secured, sealed manner and having fasteners for securing said window to said planar material, wherein said fasteners are covered in felt or any equivalent or similar material to provide a soft surface finish for preventing scratches or abrasions to the crib occupant.

3. The infant or baby crib of claim 1, further comprising:

a horizontally elongated upper rail forming a co-linear slot within its lateral length for stationary securement of an upper edge of said planar material; and a horizontally elongated lower rail forming a co-linear slot within its lateral length for stationary securement of a lower edge of said planar material.

4. The infant or baby crib of claim 3, further comprising a base having a wheel attachment disposed on each of four corners of said base.

5. The infant or baby crib of claim 4, further comprising a wheel gripper to substantially cover said wheel attachment for restricting movement of said crib once placed in a certain position and to reduce noise associated with movement of said wheel attachment.

6. The infant or baby crib of claim 1, wherein said viewing window further comprises an entertainment device integral within said viewing window for entertaining a baby or infant.

7. The infant or baby crib of claim 6, wherein said entertainment device has a sound functionality element and a lighted visual element.

8. The infant or baby crib of claim 3, further comprising:

at least one manipulating device on said upper rail for a baby or infant to manipulate.

9. The infant or baby crib of claim 8, wherein at least one of said manipulating device is a substantially circular knob capable of spinning and rotating when manipulated by a baby or infant.

10. The infant or baby crib of claim 7, wherein said entertainment device further comprises a timer device for regulating said sound functionality element and said lighted visual element to function during a predetermined fixed interval of time.

* * * * *